US008726435B2

(12) United States Patent
Briody

(10) Patent No.: US 8,726,435 B2
(45) Date of Patent: May 20, 2014

(54) PILLOWCASE WITH ONE OR MORE POCKETS

(76) Inventor: Joan McMillen Briody, The Colony, TX (US)

( * ) Notice: Subject to any disclaimer, the term of this patent is extended or adjusted under 35 U.S.C. 154(b) by 367 days.

(21) Appl. No.: 13/193,215

(22) Filed: Jul. 28, 2011

(65) Prior Publication Data

US 2013/0025052 A1 Jan. 31, 2013

(51) Int. Cl.
*A47G 9/00* (2006.01)

(52) U.S. Cl.
USPC ..... 5/632; 5/630; 5/648

(58) Field of Classification Search
USPC ..... 5/630, 632, 633, 646, 648
See application file for complete search history.

(56) References Cited

U.S. PATENT DOCUMENTS

| | | | | |
|---|---|---|---|---|
| 4,627,123 | A | 12/1986 | Uggerud | |
| 4,768,245 | A * | 9/1988 | Dutton | 5/636 |
| 4,959,880 | A * | 10/1990 | Tesch | 5/636 |
| 5,956,768 | A | 9/1999 | Pearson | |
| 6,148,458 | A | 11/2000 | Hires | |
| 6,267,638 | B1 | 7/2001 | Connolly et al. | |
| D482,923 | S | 12/2003 | Gaines | |
| D587,952 | S | 3/2009 | Skipper | |
| 2003/0075556 | A1 * | 4/2003 | Tajima et al. | 222/23 |
| 2008/0034500 | A1 | 2/2008 | Costello | |

* cited by examiner

*Primary Examiner* — Fredrick Conley

(57) ABSTRACT

A pillowcase having one or more pockets is provided. In one embodiment, the pillowcase includes a first panel, a second panel, an open end adapted to receive a pillow, and a pocket. The pocket is coupled to the pillowcase to form a pocket cavity, and an entry thereto. The pocket cavity is adapted to receive, through the entry, an appendage of a user.

18 Claims, 5 Drawing Sheets

PILLOWCASE WITH ONE OR MORE POCKETS

TECHNICAL FIELD

The illustrative embodiments relate generally to pillowcases, and more particularly, to pillowcases having one or more pockets for the appendages of a user.

BACKGROUND

While lying down or sleeping, many people prefer to lie on their right side or their left side. Frequently, a person lying on their side places a pillow between their knees. Placing a pillow between the knees while lying on one side may provide support for the hips, reduce back strain, and provide other benefits. A pillow between the knees may also make a side sleeping position more comfortable. However, during sleep, a person may frequently toss, turn, or otherwise shift position from one side to the other side. Currently available pillows may slip out of a desired position between the user's knees or otherwise slide into a less desirable position due to these potential movements during sleep.

SUMMARY

According to an illustrative embodiment, a pillowcase having one or more pockets includes a first panel, a second panel, a closed end, an open end adapted to receive a pillow, and a pocket. The first panel includes a first longitudinal edge, a closed edge, and a second longitudinal edge. The second panel includes a first longitudinal edge, a closed edge, and a second longitudinal edge. The first longitudinal edge of the first panel is coupled to the first longitudinal edge of the second panel to form a first longitudinal edge of the pillowcase. The closed edge of the first panel is coupled to the closed edge of the second panel to form a closed end of the pillowcase. The second longitudinal edge of the first panel is coupled to the second longitudinal edge of the second panel to form a second longitudinal edge of the pillowcase. The pillowcase includes a pocket coupled to the first panel to form a pocket cavity. The pocket includes a first longitudinal pocket edge, a closed end, and a second longitudinal pocket edge. The first longitudinal pocket edge is coupled to the first panel adjacent the first longitudinal edge of the pillowcase. The closed end of the pocket is coupled to the first panel adjacent the closed end of the pillowcase. The second longitudinal pocket edge is coupled to the first panel adjacent the second longitudinal edge of the pillowcase. The pocket includes an open edge adjacent to the first panel to form an entry to the pocket cavity. The pocket cavity is adapted to receive an appendage of a user. The appendage is insertable through the entry.

According to another illustrative embodiment, a pillowcase including one or more pockets is provided. The pillowcase includes a bag adapted to at least partially enclose a pillow. The bag includes an open end, a closed end, and a pocket. The pocket includes a first longitudinal pocket edge, a closed end, and a second longitudinal pocket edge coupled to the bag to form a pocket cavity. The pocket further includes an open edge adjacent to the bag to form an entry to the pocket cavity. The pocket cavity is adapted to receive an appendage of a user through the entry to the pocket cavity.

According to yet another illustrative embodiment, a pillowcase having pockets is provided. The pillowcase includes a first panel, a second panel, a closed end, an open end, a first pocket, and a second pocket. The first panel includes a first longitudinal edge, a closed edge, and a second longitudinal edge. The second panel includes a first longitudinal edge, a closed edge, and a second longitudinal edge. The first longitudinal edge of the first panel is coupled to the first longitudinal edge of the second panel to form a first longitudinal edge of the pillowcase. The closed edge of the first panel is coupled to the closed edge of the second panel to form a closed end of the pillowcase. The second longitudinal edge of the first panel is coupled to the second longitudinal edge of the second panel to form a second longitudinal edge of the pillowcase. The open end is adapted to receive a pillow. The first pocket is coupled to the first panel. The first pocket includes a first longitudinal pocket edge, a closed end of the first pocket, and a second longitudinal pocket edge coupled to the first panel to form a first pocket cavity. The first pocket includes an open edge adjacent to the first panel that forms an entry to the first pocket cavity. The first pocket cavity is adapted to receive a first foot of a use through the entry to the first pocket cavity. The first foot is insertable through the entry to the first pocket cavity. The open end of the first pocket includes a first horizontal edge and a first transverse edge. The first horizontal edge includes a first end and a second end. The first end is adjacent to the first longitudinal pocket edge of the first pocket. The first horizontal edge is substantially parallel to at least a portion of the closed end of the first pocket. The first transverse edge includes a first end and a second end. The first end is adjacent to the second longitudinal pocket edge of the first pocket. The first transverse edge forms a first angle with the second longitudinal edge. The second pocket is coupled to the second panel. The second pocket further includes an open edge of the second pocket adjacent to the second and to form an entry to the second pocket cavity. The second pocket cavity is adapted to receive a second foot of the use through the entry to the second pocket cavity. The second foot is insertable through the entry to the second pocket cavity. The open end of the second pocket includes a second horizontal edge and a second transverse edge. The second horizontal edge includes a first end and a second end. The first end is adjacent the first longitudinal pocket edge of the second pocket. The second horizontal edge is substantially parallel to at least a portion of the closed end of the second pocket. The second transverse edge includes a first end and a second end. The first end is adjacent to the second longitudinal pocket edge of the second pocket. The second transverse edge forms a second angle with the second longitudinal edge of the second pocket.

DETAILED DESCRIPTION

Figure 1:
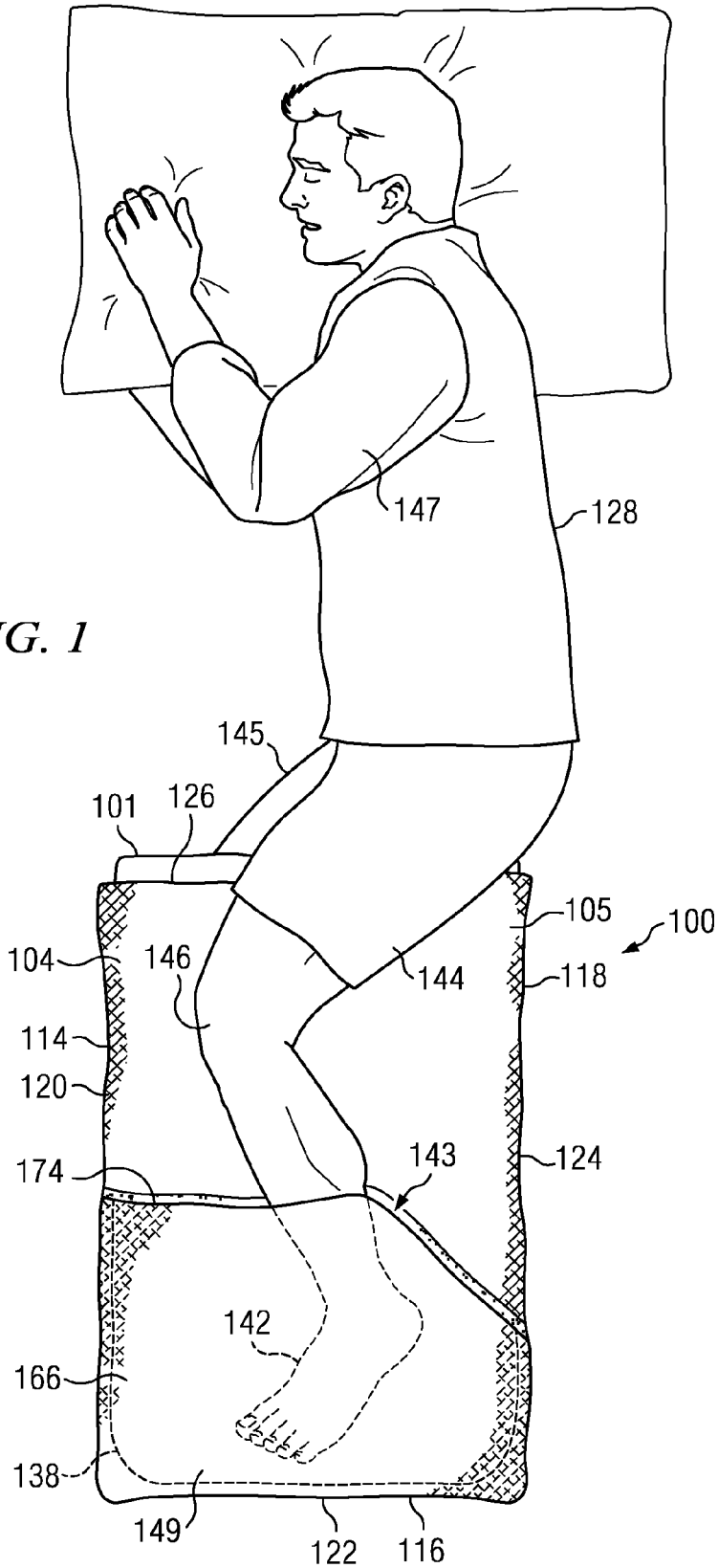
FIG. 1 is a schematic, pictorial representation of a pillowcase having one or more pockets enclosing a pillow in accordance with an illustrative embodiment.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in limiting sense, and the scope of the illustrative embodiments are defined only by the appended claims.

Referring to FIGS. 1 through 5, an illustrative embodiment of a pillowcase 100 includes one or more pockets 130, 166. The pillowcase 100 may include a bag 105 or other structure that is adapted to at least partially enclose a pillow 101. Unless otherwise indicated, as used herein, "or" does not require mutual exclusivity.

The pillowcase 100 may be positioned between the user's legs 144 and 145 while the user 128 lies on his or her side. The user's right foot 142 and left foot (not shown) may be inserted into pocket cavities 138, 139 formed by the pockets 166, 130, respectively, to help prevent the pillowcase 100 from moving out of position.

In one embodiment, the pillowcase 100 includes a first panel 102 coupled to a second and 104 to form the bag 105 or bag-like structure for at least partially enclosing the pillow 101. The panels 102, 104 may include a flat, flexible piece of material forming a portion of the bag 105 or bag-like structure.

As used herein, the term "coupled" may include coupling via a separate object and may also include direct coupling. The term "coupled" may also encompass two or more components that are continuous with one another by virtue of each of the components being formed from the same piece of material. Also, the term "coupled" may include chemical, such as via a chemical bond, mechanical (e.g., sewing, stitching, gluing, etc.), thermal, magnetic, or electrical coupling.

In one embodiment, the first panel 102 includes a first longitudinal edge 106, a closed edge 108, and a second longitudinal edge 110. The second panel 104 includes a first longitudinal edge 114, a closed edge 116, and a second longitudinal edge 118. The first longitudinal edge 106 of the first panel 102 may be coupled to the first longitudinal edge 114 of the second panel 104 to form a first longitudinal edge 120 of the pillowcase 100. The closed edge 108 of the first panel 102 may be coupled to the closed edge 116 of the second and 104 to form a closed end 122 of the pillowcase 100. The second longitudinal edge 110 of the first panel 102 may be coupled to the second longitudinal edge 118 of the second panel 104 to form a second longitudinal edge 124 of the pillowcase 100.

In one embodiment, the first panel 102 is coupled to the second panel 104 along the edges described above by one or more seams. The seam(s) may be created by sewing or stitching two layers of fabric together. In another embodiment, the first panel 102 is coupled to the second panel 104 along the edges described above at least partially by an adhesive (e.g., fabric glue, liquid thread, tape, etc.). Other portions of the pillowcase 100 that are coupled to one another may be coupled using any of the techniques or materials described above.

The pillowcase 100 includes an open end 126 adapted to receive the pillow 101. The pillowcase 100 may wholly enclose the pillow 101 or only partially enclose the pillow 101. In one embodiment, the pillowcase 100 may be sized to partially or wholly enclose the pillow 101 of any size, including, for example, but without limitation, a standard pillow, a queen size pillow, a king size pillow, a European or Continental sized pillow, a boudoir pillow, a throw pillow, a jumbo or over-sized pillow, a travel pillow, or any other size of pillow 101.

In one embodiment, the first panel 102 and the second panel 104 may be a fabric panel made of any type of fabric, including, but not limited to, natural fibers, synthetic fabrics, satin, wool, yarn, flax, silk, bamboo, linen, fleece, a combination of natural and synthetic fibers, woven fabric, non-woven fabric, or any other type of fabric. In another embodiment, the first panel 102 and the second panel 104 may be a non-fabric material, including, but not limited to, rubber, plastic, fur, faux fur, or any other type of non-fabric substance. The first and second panels 102, 104 may be made from the same, similar, or different materials, depending on embodiment. Overall, the pillowcase 100 may be made from any fabric, non-fabric, or other suitable material for creating the pillowcase 100.

While the pillowcase 100 shown in FIGS. 1-5 is a rectangular-shaped pillowcase capable of enclosing or covering one or more pillow(s) 101, the illustrative embodiments are not limited to a rectangular-shaped pillowcase 100. In another embodiment, the pillowcase 100 may be square-shaped, cylindrical-shaped, circular-shaped, oval-shaped, heart-shaped, custom-shaped, or any other shape to accommodate a wide variety of pillow shapes. In one example, the pillowcase 100 may include more than two panels, such as when the pillow 101 is multi-sided.

One or more pockets 130, 166 may be coupled to the first panel 102 or the second panel 104 of the pillowcase 100. In one embodiment, but without limitation, the pockets 130, 166 may be coupled to the first or second panel 102, 104 by a seam formed by sewing the pockets 130, 166 to the pillowcase 100.

In one embodiment, a pocket 130 coupled to the first panel 102 may include a first longitudinal pocket edge 132, a closed end 134, and a second longitudinal pocket edge 136 coupled to the first panel 102 to form a pocket cavity 139.

In one embodiment, the first longitudinal pocket edge 132 may be coupled to the first panel 102 at or adjacent the first longitudinal edge 120 of the pillowcase 100. The closed end 134 of the pocket 130 may be coupled to the first panel 102 at or adjacent the closed end 122 of the pillowcase 100. The second longitudinal pocket edge 136 may be coupled to the first panel 102 at or adjacent the second longitudinal edge 124 of the pillowcase 100. Thus, in this embodiment, the closed end 134 of the pocket 130 may be at or near the closed end 122 of the pillowcase 100.

An open edge 140 of the pocket 130 may be adjacent, but uncoupled to, the first panel 102 to form an entry 141 to the pocket cavity 139. The pocket cavity 139 may be adapted to receive an appendage, such as leg(s) 144, 145, of the user 128. The appendage is insertable into the pocket cavity 139 through the entry 141. An appendage of the user 128 that may be inserted into the pocket cavity 139 includes, e.g., a hand, part of an arm and the hand, a foot, part of a leg and the foot, etc.

In an alternate embodiment, the orientation of the pocket 130 may be flipped such that the closed end 134 of the pocket 130 may be located or coupled at or near the open end 126 of the pillowcase 100. In this embodiment, the first longitudinal pocket edge 132 may be coupled to the first panel 102 adjacent one of the first or second longitudinal edges 120, 124 of the pillowcase 100, and the second longitudinal pocket edge 136 may be coupled to the first panel 102 adjacent the other of the first or second longitudinal edges 120, 124 of the pillowcase 100. Also, in this embodiment, the closed end 134 of the pocket 130 may be coupled to the first panel 102 adjacent the open end 126 of the pillowcase 100.

Figure 3:
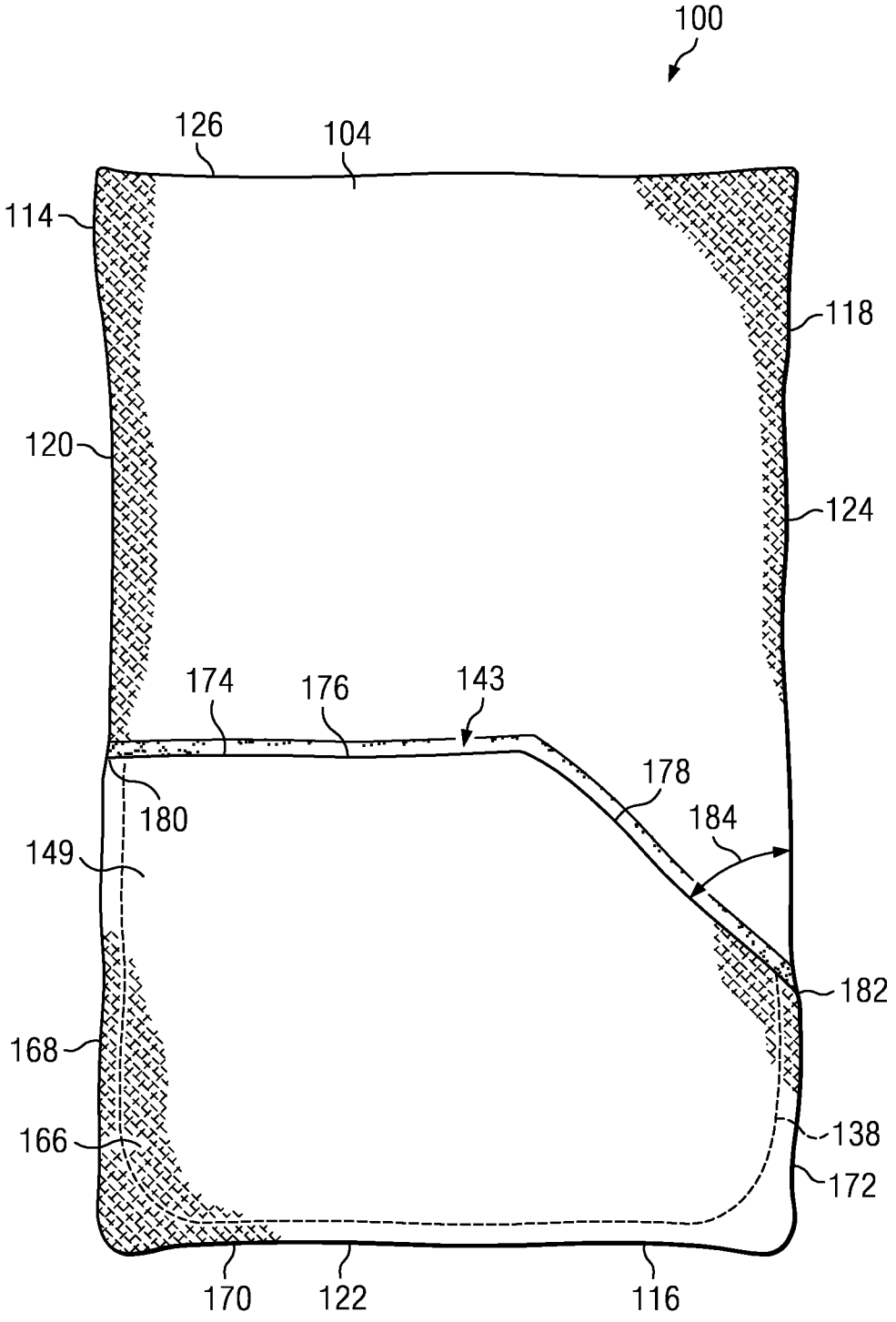
FIG. 3 is a schematic, plan view of a second panel of the pillowcase including a pocket in accordance with an illustrative embodiment.

The pillowcase 100 may also include a pocket 166 coupled to the second panel 104, an illustrative embodiment of which is shown in FIGS. 1 and 3. The pocket 166 coupled to the second panel 104 may include a first longitudinal pocket edge 168, a closed end 170, and a second longitudinal pocket edge 172 coupled to the second panel 104 to form a pocket cavity 138. The first longitudinal pocket edge 168 of the pocket 166 may be coupled the second panel 104 adjacent the first longitudinal edge 120 of the pillowcase 100. The closed end 170 of the pocket 166 may be coupled to the second panel 104 adjacent the closed end 122 of the pillowcase 100. The second longitudinal pocket edge 172 of the pocket 166 may be coupled to the second panel 104 adjacent the second longitudinal edge 124 of the pillowcase 100. Also, the pocket 166 may include an open edge 174 adjacent, but uncoupled, to the second panel 104 to create an entry 143 for the user's appendage into the pocket cavity 138.

The pockets 130 and 166 may include an exterior material layer 148 and 149, respectively. In one embodiment, the exterior material layer 148, 149 is a layer of fabric on the external surface of the pocket 130, 166 that is exposed or visible to the user 128. The exterior material layer 148, 149 may be the same color as the pillowcase 100. The exterior material layer 148, 149 may be made of the same type of material as the pillowcase 100 material. The exterior material layer 148, 149 may also optionally have the same texture as the texture of the pillowcase 100 material. Thus, in one illustrative embodiment, the exterior material layer 148, 149 may be made of the same or similar material as the material of the pillowcase 100 such that the exterior material layer 148, 149 of the pockets 130, 166 may blend with the material, texture, or color of the remainder of the pillowcase 100 to provide a uniform appearance.

In other embodiments, the color, material, and texture of the exterior material layer 148, 149 may differ from that of the pillowcase 100. In this embodiment, the exterior material layer 148, 149 may have a distinctive appearance that is different than the appearance, color, or texture of the remainder of the pillowcase 100.

Figure 4:
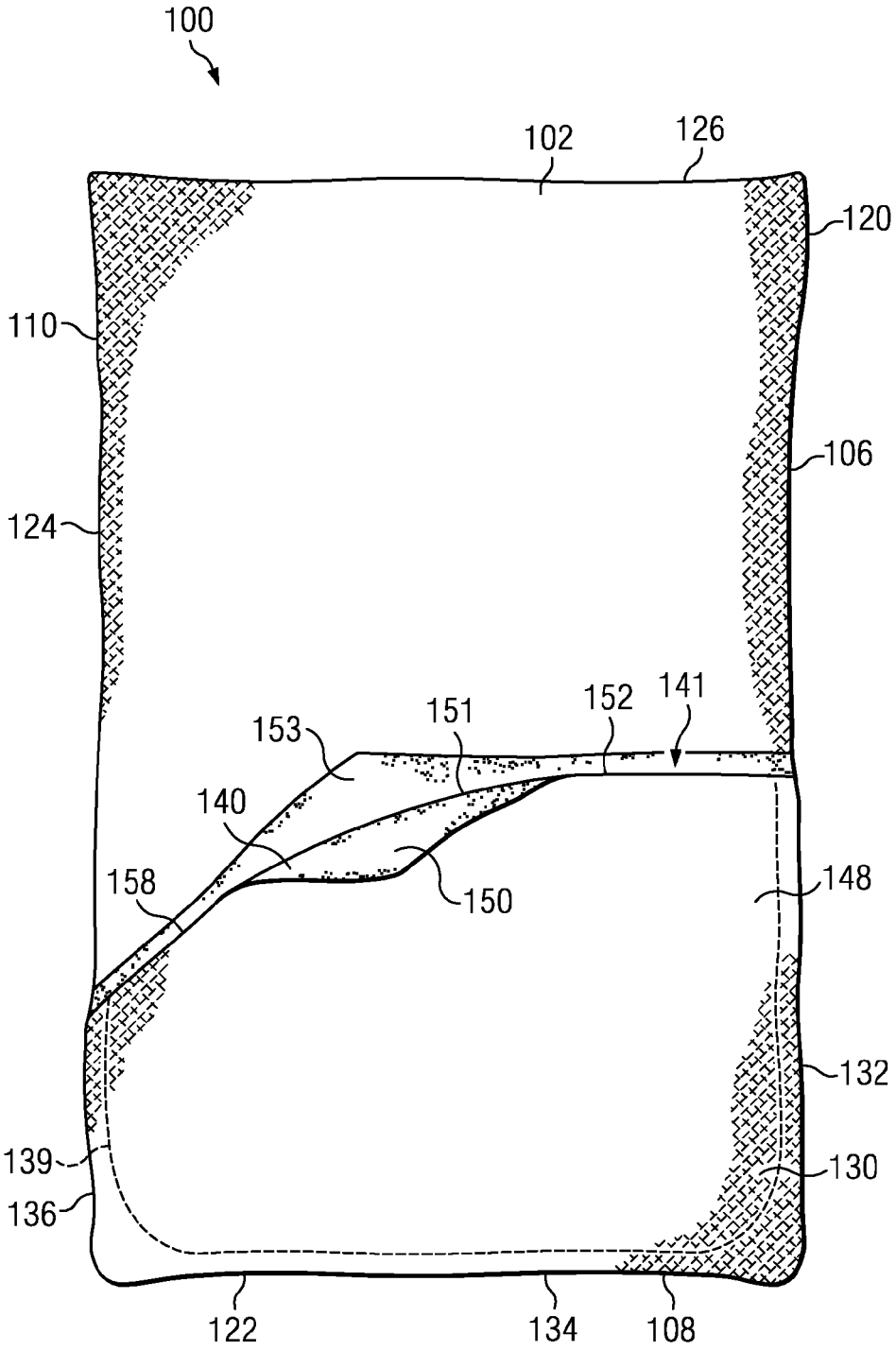
FIG. 4 is a schematic, plan view of the pillowcase in which an exterior fabric layer of a pocket is partially pulled back to expose the interior lining of a pocket cavity in accordance with an illustrative embodiment.
Figure 5:
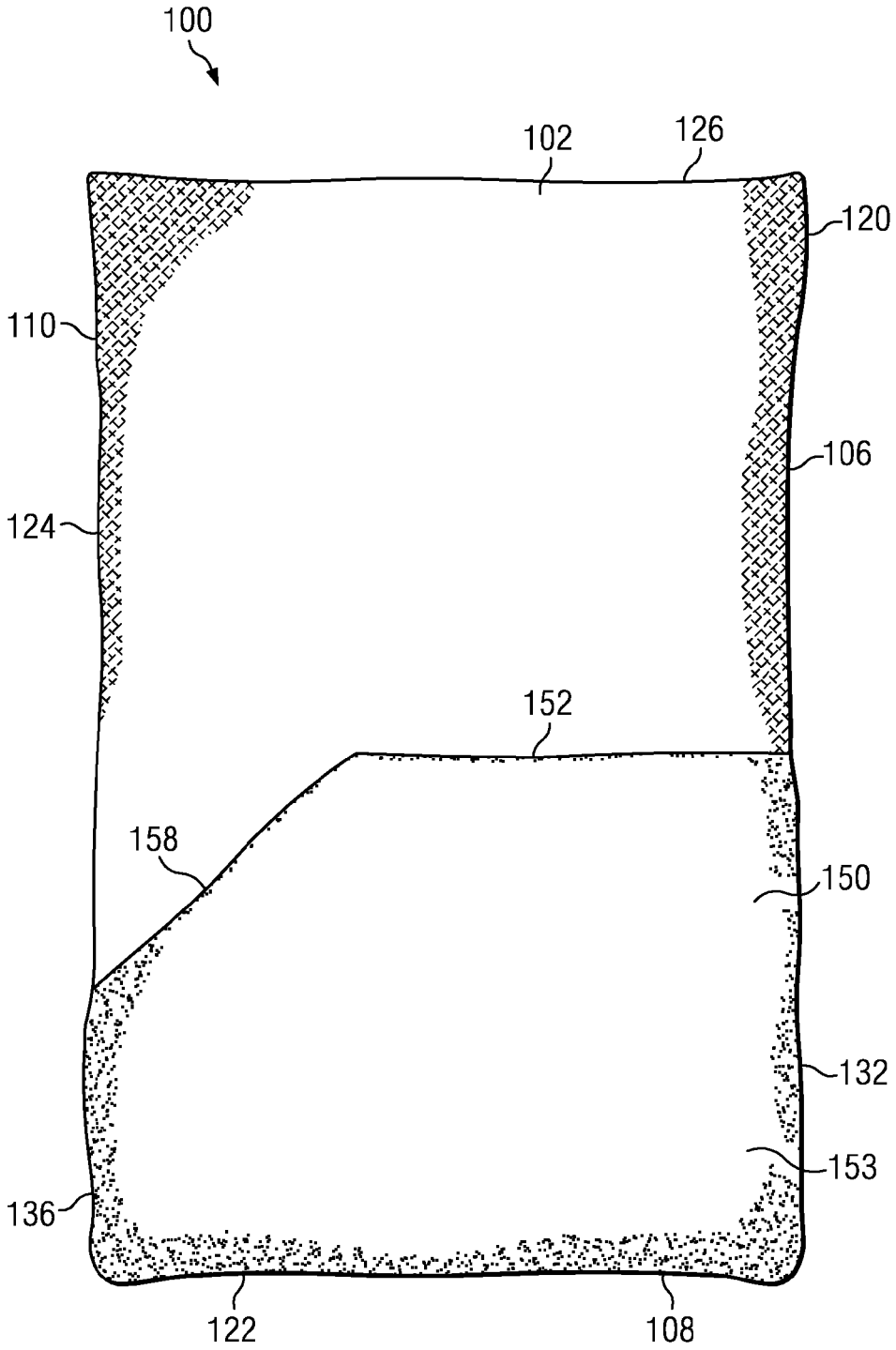
FIG. 5 is a schematic, plan view of the pillowcase in which the pocket has been removed to expose an interior lining covering the first panel in accordance with an illustrative embodiment.

In one embodiment, the pocket cavity(ies) may be formed from or lined with an interior pocket lining 150, as best shown for pocket cavity 139 in FIGS. 4 and 5. FIG. 5 shows the first panel 102 side of the pillowcase 100 with the pocket 130 removed to expose the interior of the pocket cavity 139, according to an illustrative embodiment. The pocket 130 may include an interior lining 151 that generally faces the first panel 102, and the first panel 102 may include an interior lining 153. The interior lining 153 may cover a portion of the first panel 102, or may be otherwise coupled to or contiguous with the remainder of the first panel 102. The interior pocket lining 150 may be any type of lining, including, but not limited to, a fur lining, a faux fur lining, satin, silk, cotton lining, bamboo, linen, fleece, wool, or any other type of lining. A same or similar pocket lining may also be included for the pocket cavity 138 shown in FIGS. 1 and 3.

The pockets 130, 166 may include open edges 140, 174 adjacent, but uncoupled to, the first panel 102 and the second panel 104, which create entries 141, 143 to the pocket cavities 139, 138, respectively. In another embodiment, the pocket cavities 138, 139 may receive a foot, hand, or other appendage of the user 128 through the entries 141, 143 formed by the open edges 140, 174 of the pockets 130, 166. The interior pocket linings of pocket cavities 138, 139 may increase the comfort level of the user by abutting the user's appendages with a soft or comfortable surface or texture.

The horizontal edge 152 may include a first end 154 and a second end 156. The first end 154 may be adjacent or adjoined to the first longitudinal pocket edge 132.

The second end 156 may be coupled or adjoined to a transverse edge 158. The transverse edge 158 may include a first end 160 and a second end 162. The first end 160 may be adjacent or adjoined to the second longitudinal pocket edge 136. The transverse edge 158 may form an angle 164 with the second longitudinal edge 110 of the panel 102 or the second longitudinal edge 124 of the pillowcase 100. In an embodiment that includes the transverse edge 158, the first longitudinal pocket edge 132 may have a length that is greater than a length of the second longitudinal pocket edge 136 of the pocket 130.

In embodiment, the angle 164 is an angle within a range from thirty degrees to sixty degrees. For example, but without limitation, the angle 164 may be a forty-five degree angle.

The horizontal edge 152 and the transverse edge 158 form the open edge 140 of the pocket 130, which forms an entry 141 into the pocket cavity 139. The inclusion of the transverse edge 158 may help to provide for easier insertion of a foot or other appendage into the pocket cavity 139, as well as ease of removal of the foot or other appendage from the pocket cavity 139.

In an alternate embodiment, the open edge 140 of the pocket 130 is an entirely horizontal edge, and does not include the transverse edge 158. In this embodiment, the horizontal edge 152 may be a straight edge running substantially parallel to the closed end 122 of the pillowcase 100. In this embodiment, the first longitudinal pocket edge 132 and the second longitudinal pocket edge 136 may be approximately equal in length.

In another alternate embodiment, the open edge 140 of the pocket 130 is an entirely transverse edge, and does not include the horizontal edge 152. In this embodiment, the entry 141 to the pocket cavity 139 may be formed by a pocket edge that is entirely, or nearly entirely, slanted or angled relative to the ends 122, 126 of the pillowcase 100.

In another alternate embodiment, the closed end 134 of the pocket 130 may be uncoupled to the first panel 102 to form an exit opening (not shown) through which an appendage may extend. In this embodiment, user's appendage may enter the pocket cavity 139 through the entry 141 and exit the pocket cavity 139 through the exit opening formed from the partially or fully uncoupled closed end 134 of the pocket 130. Also in this embodiment, the pocket 130 may be located anywhere on the pillowcase 100 so that different parts of the user's appendages may be covered (e.g., foot, leg, knee, elbow, etc.), depending on the location.

In yet another alternate embodiment, instead of utilizing pockets 130, 166 to secure the user's appendages to the pillowcase 100, the pillowcase 100 may include one or more elastic or inelastic straps coupled anywhere on the pillowcase 100. In this embodiment, the user 128 may slide his or her appendages into the straps, which may help to prevent the pillowcase 100 from being undesirably repositioned. These straps may be any length, and may he made from any material, including materials having a soft or comfortable texture.

Analogous to the open edge 140 of the pocket 130 coupled to the first panel 102, the open edge 174 of the pocket 166 coupled to the second panel 104 may also include a horizontal edge 176 and a transverse edge 178, as shown in FIG. 3. In this embodiment, the first longitudinal pocket edge 168 may have a length that is greater than a length of the second longitudinal pocket edge 172 of the pocket 166. The horizontal edge 176 may be substantially parallel to the closed end 116 of the pocket 166 or the closed end 122 of the pillowcase 100. A first end 180 of the horizontal edge 176 may be adjacent the first longitudinal pocket edge 168. The transverse edge 178 may include a first end 182 adjacent the second longitudinal pocket edge 172. The transverse edge 178 may form an angle 184 with the second longitudinal edge 118 of the second panel 104. In one illustrative embodiment, the angle 184 may be an angle within a range from thirty degrees to sixty degrees. In one embodiment, the angle 184 may be a forty-five degree angle.

The pocket 166 may have any of the alternative embodiments described above with respect to the pocket 130.

The possible sizes of the pocket 130 are numerous. For example, the pocket 130 may cover less than half the total surface area of the first panel 102. In another embodiment, the pocket 130 may cover substantially entire total surface area of the first panel 102. In still another embodiment, the pocket 130 may cover approximately half of the total surface area of the first panel 102. In yet another embodiment, the pocket 130 may cover any area of the first and that is less than the total surface area of the first panel 102. These same embodiments may also apply to the pocket 166 covering the second panel 104. Also, the two pockets 130 and 166 may be substantially the same size, or may differ in size. In addition, the pockets 130, 166, and their associated pocket cavities 139, 166, may have varying depths that receive varying portions of the user's appendages (e.g., only foot, foot and a few inches of leg, foot and knee, etc.). In other embodiments, the pockets 130, 166 may be located anywhere on the pillowcase 100.

Figure 2:
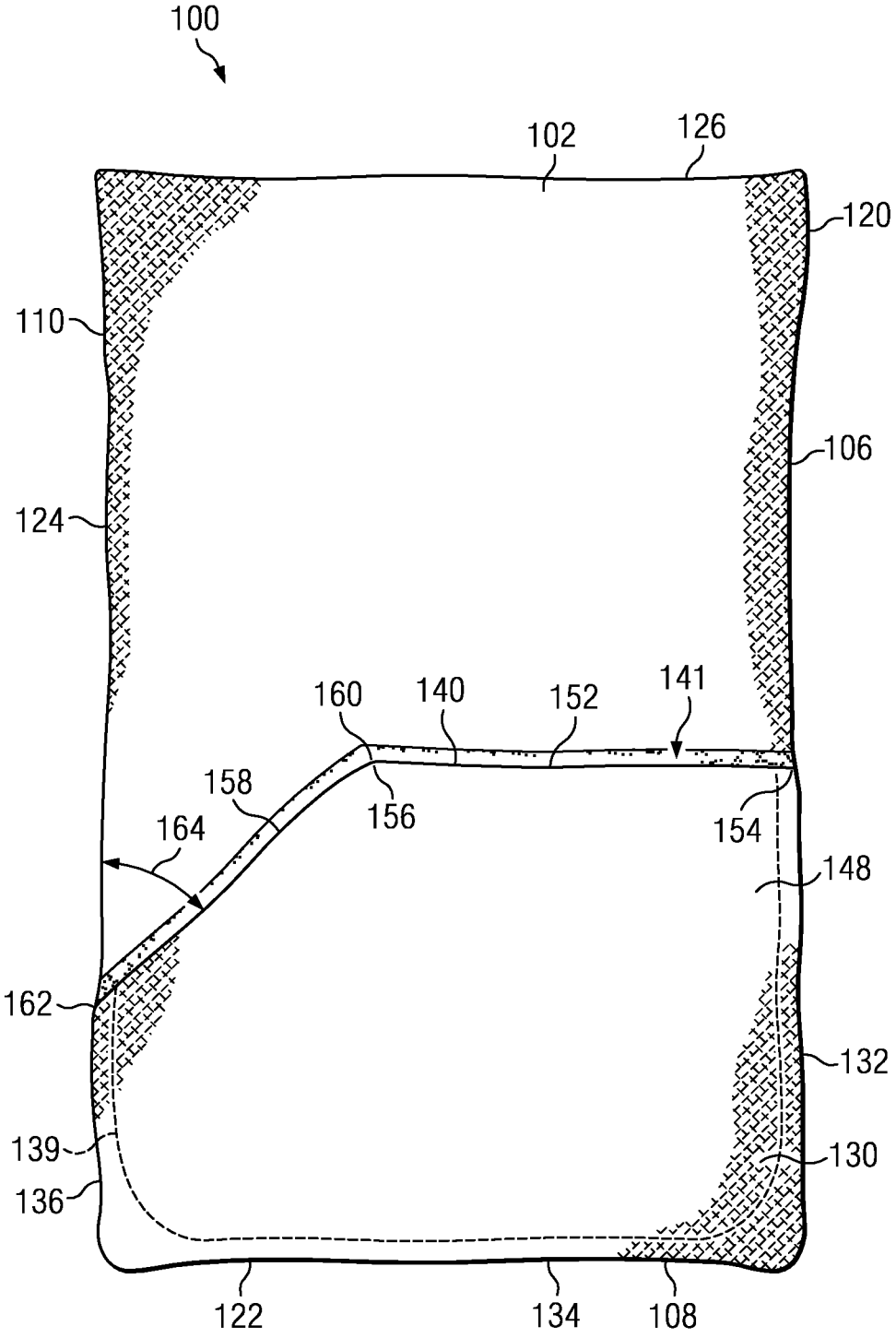
FIG. 2 is a schematic, plan view of a first panel of the pillowcase including a pocket in accordance with an illustrative embodiment.

In one embodiment, the pillowcase 100 may have one pocket 130 on one side of the pillowcase 100 (as shown in FIG. 2) and another pocket 166 on the opposite side of the pillowcase 100 (as shown in FIG. 3). In this embodiment, the pocket 130 may be coupled to the first panel 102 and the other pocket 166 may be coupled to the second panel 104. In another embodiment, the pillowcase 100 may have only one pocket 130 or 166 on the pillowcase 100. In this embodiment, the pillowcase 100 may have a single pocket on only one side of the pillowcase 100 and no pockets on the other side of the pillowcase 100.

In yet another embodiment, the pillowcase 100 may include three or more pockets. For example, the pillowcase 100 may have two or more pockets on the outside surface of the pillowcase 100 and two or more pockets on the inside surface of the pillowcase 100. In this example, when the pillowcase 100 is turned inside out, pockets will still be available for insertion of the appendage(s) of the user 128.

In one embodiment, the user 128 may place the pillowcase 100, which at least partially encloses the pillow 101, between the legs 144, 145 or knees 146 of the user 128, as shown in FIG. 1. The user 128 may insert a single foot 142 into the pocket cavity 138 with the legs 144, 145 straight or with the knees 146 bent as the user 128 lays on his or her right side or left side.

In another use, the user 128 may place both feet inside the pockets 130, 166. The user may insert one foot 142 into the pocket cavity 139 formed by the pocket 130 that is coupled to the first panel 102, and the other foot into the pocket cavity 138 formed by the pocket 166 that is coupled to the second panel 104. In this manner, the user 128 may rest or sleep with the pillow 101 enclosed by pillowcase 100 between the user's legs 144, 145 with one foot in each of the pockets 130, 166 on each side of the pillowcase 100. When the user's feet are inserted into the pocket cavities 138, 139, the pillow 101 enclosed by pillowcase 100 may be prevented from slipping out of a desired position between the user's legs and/or knees. The pillow 101 enclosed within the pillowcase 100 may be secured to the user's feet and therefore, move with the user 128.

The pockets 130, 166 may provide stability and more secure positioning of the pillowcase-enclosed pillow 101 in the position desired by the user 128. The user 128 may toss, turn, roll, shift, or move while resting or sleeping without concern, for re-adjusting or re-positioning the pillow.

Using the illustrative embodiments in this way may facilitate posture, comfort, and/or the general health of the user 128, while helping to ensure that the pillowcase 100 is stays secured between the user's legs during the movements associated with sleep or rest.

In another embodiment, the user 128 may place the pillowcase-enclosed pillow 101 between the user's arms 147 and place one or more hands within the pocket cavities 138, 139 of the pillowcase 100. In this embodiment, the user 128 may roll, turn, and move during rest or sleep without dislodging the pillowcase-enclosed pillow 101 from the user's hands or arms.

In addition, the interior pocket lining 150 of the pockets 130, 166 may also provide additional softness, warmth, and/or comfort to the user's feet or hands.

As used herein, including in the claims, the terms first, second, third, etc. used in relation to an element (e.g., first panel, second panel, etc.) are for reference or identification purposes only, and these terms, unless otherwise indicated, are not intended to describe or suggest a number, order, source, purpose, or substantive quality for any element for which such a term is used.

Although the illustrative embodiments described herein have been disclosed in the context of certain illustrative, non-limiting embodiments, it should be understood that various changes, substitutions, permutations, and alterations can be made without departing from the scope of the invention as defined by the appended claims. It will be appreciated that any feature that is described in a connection to any one embodiment may also be applicable to any other embodiment.

What is claimed is:

1. A pillowcase having one or more pockets comprising:

a first panel having a first longitudinal edge, a closed edge, and a second longitudinal edge;

a second panel having a first longitudinal edge, a closed edge, and a second longitudinal edge, the first longitudinal edge of the first panel coupled to the first longitudinal edge of the second panel to form a first longitudinal edge of the pillowcase, the closed edge of the first panel coupled to the closed edge of the second panel to form a closed end of the pillowcase, and the second longitudinal edge of the first panel coupled to the second longitudinal edge of the second panel to form a second longitudinal edge of the pillowcase;

an open end adapted to receive a pillow; and a pocket coupled to the first panel to form a pocket cavity, the pocket having a first longitudinal pocket edge, a closed end, and a second longitudinal pocket edge, the first longitudinal pocket edge coupled to the first panel adjacent the first longitudinal edge of the pillowcase, the closed end of the pocket coupled to the first panel adjacent the closed end of the pillowcase, and the second longitudinal pocket edge coupled to the first panel adjacent the second longitudinal edge of the pillowcase, the pocket further comprising:

an open edge adjacent the first panel to form an entry to the pocket cavity, the pocket cavity adapted to receive an appendage of a user, the appendage insertable through the entry;

wherein the pocket is a first pocket and the pocket cavity is a first pocket cavity, the pillowcase further comprising:

a second pocket coupled to the second panel to form a second pocket cavity, wherein a first appendage of the user is insertable into the first pocket cavity, and a second appendage of the user is insertable into the second pocket cavity.

2. The pillowcase having one or more pockets of claim 1 wherein the open edge of the pocket comprises:

a horizontal edge having a first end and a second end, the first end of the horizontal edge adjacent the first longitudinal pocket edge, wherein the horizontal edge is substantially parallel to at least a portion of the closed end of the pocket; and a transverse edge having a first end and a second end, the first end of the transverse edge adjacent the second longitudinal pocket edge, wherein the transverse edge forms an angle with the second longitudinal edge.

3. The pillowcase having one or more pockets of claim 2 wherein the angle is an angle within a range from thirty degrees to sixty degrees.

4. The pillowcase having one or more pockets of claim 1 wherein the first longitudinal pocket edge has a length that is greater than a length of the second longitudinal pocket edge of the pocket.

5. The pillowcase having one or more pockets of claim 1 wherein the pocket covers a portion of the first panel and further comprises:

an interior lining facing the first panel, wherein the interior lining of the pocket and the portion of the first panel covered by the pocket comprises at least one of fur, faux fur, linen, fleece, bamboo, satin, cotton fabric, or wool.

6. The pillowcase having one or more pockets of claim 1 the second pocket having a first longitudinal pocket edge, a closed end, and a second longitudinal pocket edge coupled to the second panel to form the second pocket cavity, the first longitudinal pocket edge of the second pocket coupled to the second panel adjacent the first longitudinal edge of the pillowcase, the closed end of the second pocket coupled to the second panel adjacent the closed end of the pillowcase, and the second longitudinal pocket edge of the second pocket coupled to the second panel adjacent the second longitudinal edge of the pillowcase, the second pocket further comprising:

an open edge of the second pocket adjacent the second panel to form an entry to the second pocket cavity, the second pocket cavity adapted to receive the second appendage of the user, the second appendage insertable through the entry to the second pocket cavity.

7. The pillowcase having one or more pockets of claim 1 wherein the pocket further comprises: an exterior fabric layer, wherein the exterior fabric layer is a same fabric as a fabric of the first panel, and wherein the first panel and the exterior fabric layer of the pocket have a uniform color and texture.

8. The pillowcase having one or more pockets of claim 1 wherein the first panel has a total surface area, and wherein the pocket covers approximately half of the total surface area of the first panel.

9. A pillowcase having pockets comprising:

a first panel having a first longitudinal edge, a closed edge, and a second longitudinal edge;

a second panel having a first longitudinal edge, a closed edge, and a second longitudinal edge, the first longitudinal edge of the first panel coupled to the first longitudinal edge of the second panel to form a first longitudinal edge of the pillowcase, the closed edge of the first panel coupled to the closed edge of the second panel to form a closed end of the pillowcase, and the second longitudinal edge of the first panel coupled to the second longitudinal edge of the second panel to form a second longitudinal edge of the pillowcase;

an open end adapted to receive a pillow;

a first pocket coupled to the first panel, the first pocket having a first longitudinal pocket edge, a closed end of the first pocket, and a second longitudinal pocket edge coupled to the first panel to form a first pocket cavity, and wherein the first pocket further comprises:

an open edge adjacent to the first panel to form an entry to the first pocket cavity, and wherein the first pocket cavity is adapted to receive a first foot of a user through the entry to the first pocket cavity, the first foot insertable through the entry to the first pocket cavity, wherein the open end of the first pocket further comprises:

first horizontal edge having a first end and a second end, the first end adjacent the first longitudinal pocket edge, wherein the first horizontal edge is substantially parallel to at least a portion of the closed end of the first pocket; and a first transverse edge having a first end and a second end, the first end adjacent the second longitudinal pocket edge, wherein the first transverse edge forms a first angle with the second longitudinal edge; and a second pocket coupled to the second panel, wherein the second pocket further comprises:

an open edge of the second pocket adjacent to the second panel to form an entry to the second pocket cavity, and wherein the second pocket cavity is adapted to receive a second foot of the user through the entry to the second pocket cavity, the second foot insertable through the entry to the second pocket cavity, and wherein the open end of the second pocket further comprises:

a second horizontal edge having a first end and a second end, the first end adjacent the first longitudinal pocket edge, wherein the second horizontal edge is substantially parallel to at least a portion of the closed end of the second pocket; and a second transverse edge having a first end and a second end, the first end adjacent the second longitudinal pocket edge, wherein the second transverse edge forms a second angle with the second longitudinal edge.

10. The pillowcase having pockets of claim 9 wherein the wherein the angle is an angle within a range from thirty degrees to sixty degrees.

11. A pillowcase having one or more pockets comprising:

a bag adapted to at least partially enclose a pillow, the bag comprising an open end and a closed end; and a pocket having a first longitudinal pocket edge, a closed end, and a second longitudinal pocket edge coupled to the bag to form a pocket cavity, wherein the pocket further comprises an open end adjacent to the bag to form an entry to pocket cavity, and wherein the pocket cavity is adapted to receive an appendage of a user through the entry to the pocket cavity, wherein the pocket further comprises: an exterior fabric laver; and an interior lining facing the bag.

12. The pillowcase having one or more pockets of claim 11 wherein the open end of the pocket comprises:

a horizontal edge having a first end and a second end, the first end adjacent the first longitudinal pocket edge, wherein the horizontal edge is substantially parallel to at least a portion of the closed end of the pocket; and a transverse edge having a first end and a second end, the first end adjacent the second longitudinal pocket edge, wherein the transverse edge forms an angle with the second longitudinal edge.

13. The pillowcase having one or more pockets of claim 11 wherein the first longitudinal, pocket edge has a length that is greater than a length of the second longitudinal pocket edge of the pocket.

14. The pillowcase having one or more pockets of claim 11 wherein the appendage is a foot.

15. The pillowcase having one or more pockets of claim 11 wherein the appendage is a hand.

16. The pillowcase having one or more pockets of claim 11 wherein the first longitudinal pocket edge is coupled to the bag adjacent the first longitudinal edge of the bag, the closed end of the pocket coupled to the bag adjacent to the closed end of the bag, and the second longitudinal pocket edge coupled to the bag adjacent the second longitudinal edge of the bag.

17. The pillowcase having one or more pockets of claim 11 wherein the pocket covers a portion of the bag, wherein the interior lining of the pocket and the portion of the bag covered by the pocket comprises a same material.

18. The pillowcase having one or more pockets of claim 11 wherein the exterior fabric layer is made from a different material than the interior lining.

* * * * *